US006422775B1

(12) United States Patent
Bramlett et al.

(10) Patent No.: US 6,422,775 B1
(45) Date of Patent: Jul. 23, 2002

(54) DIGITAL MESSAGING PEN

(75) Inventors: Brian W. Bramlett, Portland; Frank T. Brown, Beaverton, both of OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/816,549

(22) Filed: Mar. 23, 2001

(51) Int. Cl.[7] ..... B43K 29/00

(52) U.S. Cl. ..... 401/195; 382/188; 382/189; 401/194

(58) Field of Search ..... 401/195, 52, 222, 401/194; 382/186, 187, 188, 189; 345/179

(56) References Cited

U.S. PATENT DOCUMENTS 4,141,073 A * 2/1979 Tan ..... 364/705
5,142,161 A * 8/1992 Brackmann ..... 401/195
5,215,397 A * 6/1993 Taguchi et al. ..... 401/195
5,294,792 A * 3/1994 Lewis et al. ..... 250/221
5,939,702 A * 8/1999 Knighton et al. ..... 401/195
6,130,666 A * 10/2000 Persidsky ..... 345/179

* cited by examiner

*Primary Examiner*—David J. Walczak
(74) *Attorney, Agent, or Firm*—Marger Johnson & McCollom, P.C.

(57) ABSTRACT

A digital messaging pen includes a writing nib that a user can use to write a message. The digital messaging pen captures the message. The user then selects a destination for the message, and the digital messaging pen transmits the message to the destination.

36 Claims, 4 Drawing Sheets

DIGITAL MESSAGING PEN

RELATED APPLICATION DATA

This invention is related to commonly assigned U.S. patent application Ser. No. 09/816,556, titled "Coordinated Knob and Display For Navigation of Hierarchical and Range Selectors," filed Mar. 23, 2001, incorporated by reference herein.

FIELD OF THE INVENTION

This invention pertains to a messaging device, and more particularly to a messaging device that can capture messages.

BACKGROUND OF THE INVENTION

Ink and paper have been around for centuries as a means for communicating. One person writes something on a piece of paper (papyrus and parchment were early predecessors of today's paper), which could then be delivered to another for reading. For example, passing notes in school was a common way of communicating furtively. One kid would write a note one a piece of paper, which would then be passed hand-to-hand to the recipient.

With the advent of the digital age, communications have entered the digital world. Personal digital assistants (PDAs) are prevalent everywhere in society today. They allow users to share information electronically, without the tedious long-hand writing of information. The Apple Newton® was an early success in the field of PDAs, allowing users to communicate wirelessly with each other. More recently, Cybiko, Inc. has released the Cybiko™ Wireless Intertainment Computer, marketed as a wireless handheld computer for teenagers. (Apple and Newton are registered trademarks of Apple Computer, Inc. in the United States and other countries. Cybiko is a trademark of Cybiko, Inc.)

But both the Apple Newton and the Cybiko Wireless Intertainment Computer are specialized devices, requiring the user to use the provided hardware. The Cybiko Wireless Intertainment Computer provides the user with a small keyboard and pointing device for purposes of inputting a message. The Apple Newton graphically captured a message handwritten on the touch-screen of the device using a stylus. As such, neither is capable of capturing a message written on a random writing surface.

The present invention addresses this and other problems associated with the prior art.

DETAILED DESCRIPTION

Figure 1:
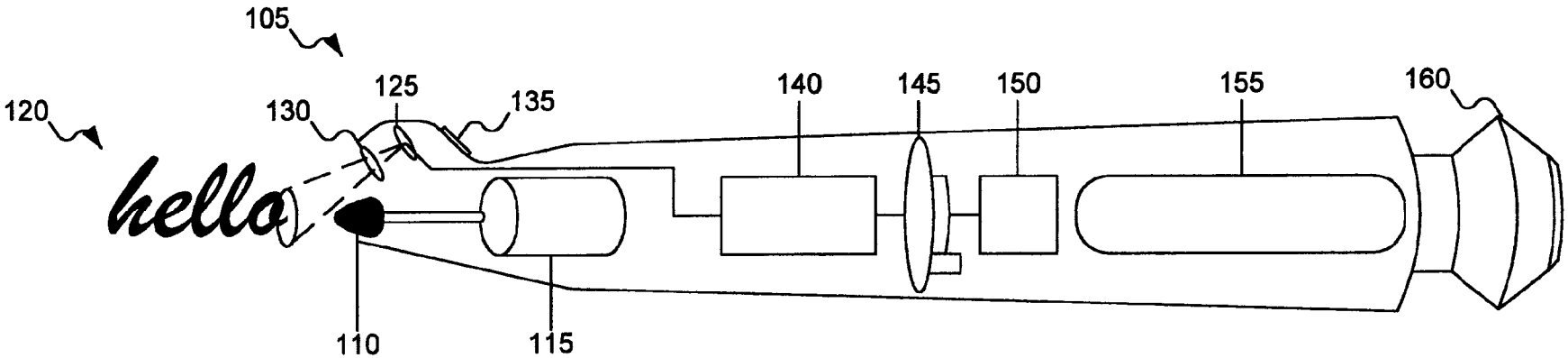
FIG. 1 shows a digital messaging pen according to an embodiment of the invention.

FIG. 1 shows a digital messaging pen according to an embodiment of the invention. In FIG. 1, digital messaging pen 105 includes nib 110, enclosed by housing 112. Nib 110 is a writing nib used to write on a writing surface. Nib 110 is fed ink from ink cartridge 115. In this way, digital messaging pen may be used like any other pen for writing. In FIG. 1, the user has just finished writing word "hello" (120).

Digital messaging pen 105 includes a sensor for capturing the message written by the user (such as "hello" 120). In one embodiment, optical sensor 125 and lens 130 are used to optically capture the message. In a second embodiment, an accelerometer is used to track the motion of digital messaging pen 105, and a pressure sensor is used to determine when nib 110 is pressed to the writing surface (the accelerometer and pressure sensor are not shown in FIG. 1). A person skilled in the art will recognize other possible embodiments as well. The message may be captured graphically and transmitted as a graphic, or character recognition software may be used to determine the characters written, so that the message may be transmitted using a code (such as ASCII or EBCDIC) rather than as a graphic.

Because digital messaging pen 105 may be used as an ordinary pen as well as for capturing messages, activation button 135 may be pressed by the user when a message is to captured for later transmission. In FIG. 1, activation button 135 is located convenient to the user's hand when writing. When activation button 135 is not depressed, digital messaging pen 105 acts as an ordinary pen.

The user may wish to store several frequently used messages for transmission to others. Memory 140 may be used to store the captured messages. Memory 140 may also be used to store a list of possible recipients for the transmitted message. Memory 140 may also act as a storage medium to store the instructions. The stored instructions may implement the procedures described herein, such as capturing a message, that control the operation of digital messaging pen 105.

Microcontroller 145 controls the use of the digital features of digital messaging pen 105. For example, microcontroller 145 is responsible for activating and processing information from the sensors that capture the message for transmission. Microcontroller 145 is also responsible for storing messages in and retrieving messages from memory 145, and for transmitting a message to a destination device. A person skilled in the art will also recognize other things microcontroller 145 may do.

To transmit a message to a destination device, digital messaging pen 105 includes wireless transmitter 150. Wireless transmitter 150 takes the message and transmits it to the appropriate destination device. Destination devices may include other digital messaging pens, personal digital assistants (PDAs), and any other device capable of receiving a wireless transmission. In addition, a properly configured computer capable of receiving wireless transmissions can receive a message from digital messaging pen 105. The message may be transmitted using any wireless protocol, including radio-frequency (RF) transmission, infrared transmission, Bluetooth, and the like. For example, wireless TCP/IP and Wireless Area Protocol (WAP) protocols may be used to transmit the message.

Wireless transmitter 150 may also include a wireless receiver (not shown in FIG. 1). The wireless receiver may be used to receive messages from other digital messaging pens and other devices. Once received, the message may be displayed on display 155. The message may also be stored in memory 140 for later retrieval and display, as desired by the user.

When a message is received by digital messaging pen 105, digital messaging pen 105 may notify the user of the received message. The notification may be controlled using appropriate software. For example, digital messaging pen 105 may do nothing, so that the user checks digital messaging pen 105 to see if any messages have been received. Alternatively, digital messaging pen 105 may signal a received message aurally, visually, or tactilely. Finally, digital messaging pen 105 may suppress or change the means of notification, depending on the surrounding environment. In essence, digital messaging pen 105 is context aware.

If an appropriate wireless protocol is used, digital messaging pen 105 may be addressable over a network. Digital messaging pen 105 may then receive messages from devices on the network. For example, a user on the network might send an electronic message to digital messaging pen 105, which may receive the message and display it to the user.

Because digital messaging pen 105 is portable (as are many wireless devices), digital messaging pen 105 may be able to intercommunicate with an ever-changing list of devices, depending on what devices are nearby. For example, digital messaging pen 105 may be able to communicate with a second digital messaging pen in the room. Then, another person may enter the room, bringing with him a PDA. Digital messaging pen 105 may now be able to communicate with the PDA. When the user with the second digital messaging pen leaves the room, digital messaging pen 105 may no longer be able to communicate with the second digital messaging pen.

To address this ever-changing list of devices available for communication, digital messaging pen 105 periodically wirelessly scans the area for other wireless devices capable of communicating with digital messaging pen 105. (Digital messaging pen 105 may also send out a notice that it is in the area, to notify any devices not aware of the presence of digital messaging pen 105.) As described above, any wireless protocol may be used for the scan. Once the scan is complete, digital messaging pen 105 may update its internal list of devices available for communication. Then, when the user is ready to send a message, digital messaging pen 105 may provide the user with a list of devices available for intercommunication.

In an alternative embodiment, digital messaging pen 105 may include a selection device, which may be used, for example, to select a message or a destination for a message. In FIG. 1, the selection device includes knob 160 and display 155. Knob 160 is used to navigate a menu. Twisting knob 160 allows a user to view the different choices within the menu: for example, to select a message or message destination. Pushing or pulling knob 160 allows the user to select or reject, respectively, a current choice in the menu. A person skilled in the art will recognize that either pushing or pulling knob 160 may be used to select or reject a selection, but it is more intuitive to push knob 160 in the direction of selection device 105 to select a menu choice.

As the user navigates the menu using knob 160 (both by twisting knob 160 and by pushing or pulling knob 160), display 155 is updated to reflect the current choice. Thus, as the user twists knob 160, display 155 scrolls up/down to reflect the change in the selection, "rotating" the selection in display 155 to correspond with the direction knob 160 is rotated. Then, when the user selects or rejects a selection, display 155 scrolls left/right to reflect the selection or rejection of a choice in the menu.

The menu navigated by the user is stored in memory 140 within digital messaging pen 105. As discussed above, the user may add new messages to the menu, and digital messaging pen 105 may update the list of available devices for intercommunication. Although the menu update will typically be done with wireless communication (using wireless transmitter 150), the update may also be done using wired communication with a second device. In this case, digital messaging pen 105 may include a plug (not shown) to which a second device may be connected. The menu update may then be downloaded from the second device.

The menu may have only a single level (with one or more selections), or it may have multiple levels. If the menu has multiple levels, then some selections within the menu will cascade to a lower level menu. Accepting these selections will open the lower level menus. Conversely, if the user is at a lower level menu and rejects a selection, the user will be brought to a higher level menu.

Figure 4:
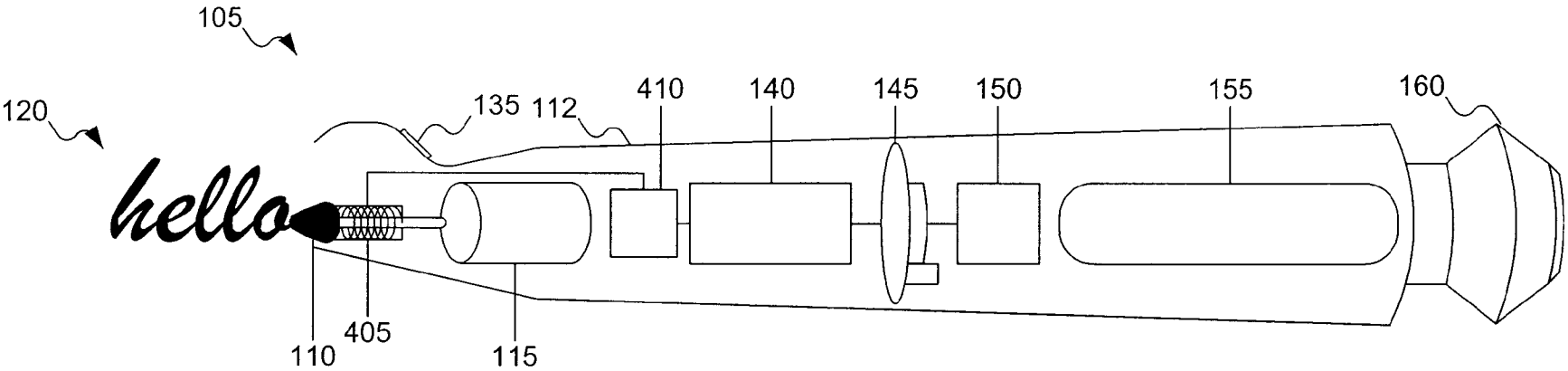
FIG. 4 shows the digital messaging pen of FIG. 1 using an accelerometer and pressure sensor, according to an embodiment of the invention.

FIG. 4 shows the digital messaging pen of FIG. 1 using an accelerometer and pressure sensor, according to an embodiment of the invention. In FIG. 4, nib 110 is attached to pressure sensor 405, which senses when nib 110 is pressed against a writing surface. At the same time, accelerometer 410 detects the motion of pen 105. Data from pressure sensor 405 and accelerometer 410 are returned to microcontroller 145, which can then determine the message.

Figure 2:
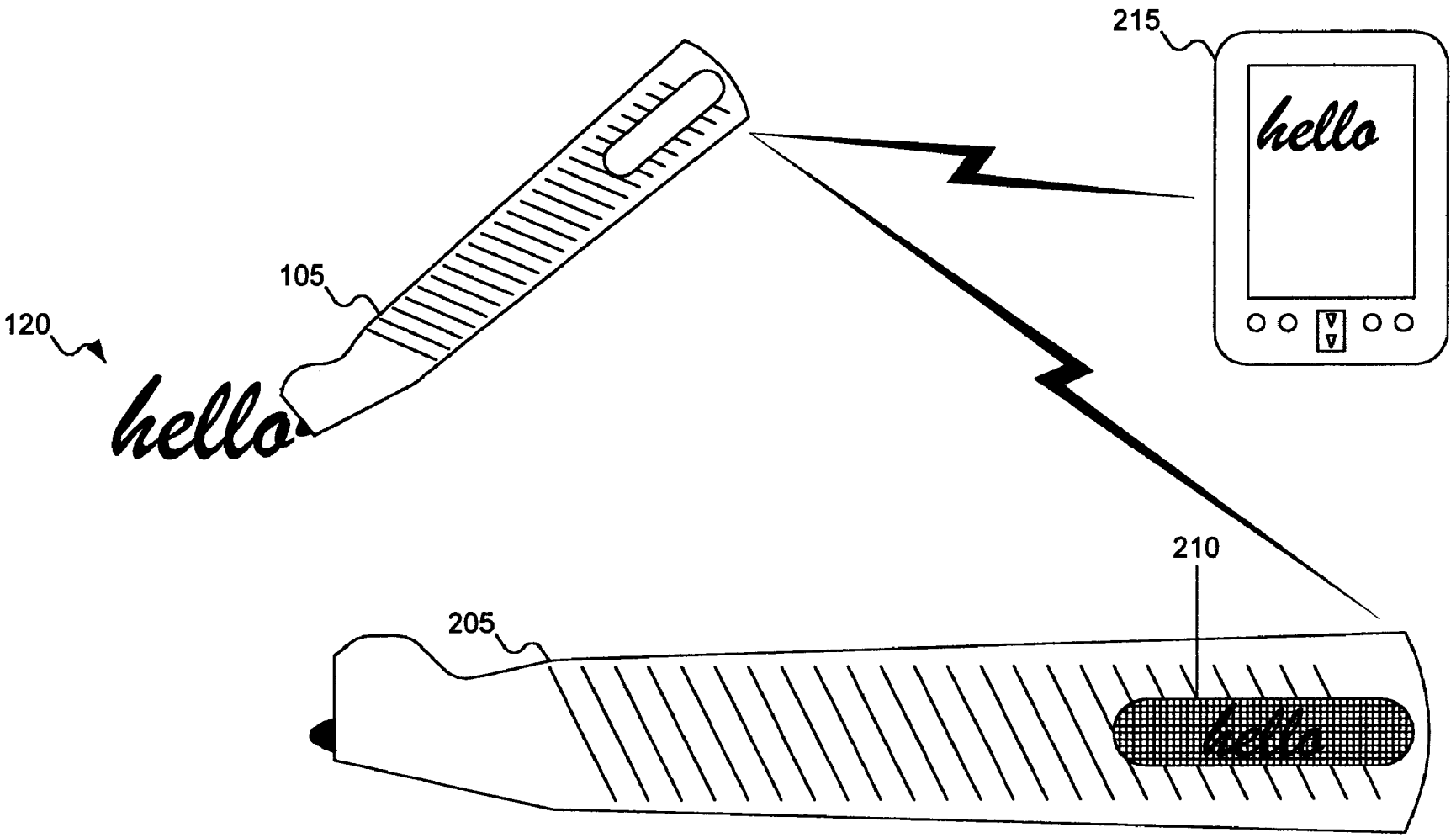
FIG. 2 shows the digital messaging pen of FIG. 1 communicating with other devices.

FIG. 2 shows the digital messaging pen of FIG. 1 communicating with other devices. In FIG. 2, digital messaging pen 105 has been used to write the word "hello" 120. The user has chosen to transmit the message to two available devices. Digital messaging pen 205 has received the message, which is displayed on display 210 of digital messaging pen 205. PDA 215 has also received the message, and displayed it for the PDA user.

Figure 3:
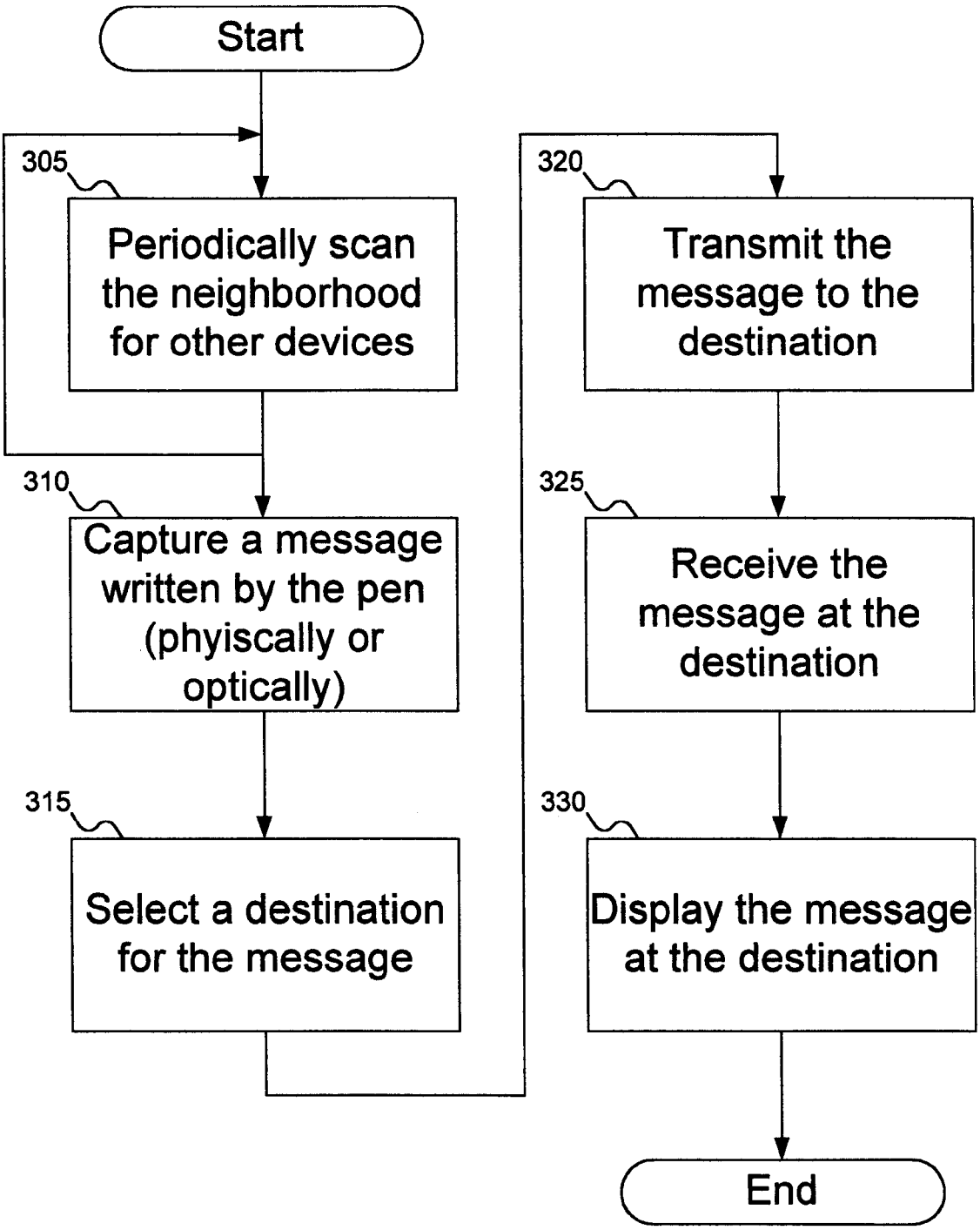
FIG. 3 shows the procedure used by the digital messaging pen of FIG. 1 to capture a message and transmit it to a second device, as shown in FIG. 2.

FIG. 3 shows the procedure used by the digital messaging pen of FIG. 1 to capture a message and transmit it to a second device, as shown in FIG. 2. At block 305, the digital messaging pen periodically scans the neighborhood for other devices with which the digital messaging pen may communicate. At block 310, the digital messaging pen captures a message written by the user (either optically or physically). (Alternatively, the user may select a saved message for transmission.) At block 315, the user selects a destination for the message. At block 320, the digital messaging pen transmits the message to the destination. At block 325, the destination device receives the message. Finally, at block 330, the destination displays the message.

Having illustrated and described the principles of our invention in an embodiment thereof, it should be readily apparent to those skilled in the art that the invention can be modified in arrangement and detail without departing from such principles. We claim all modifications coming within the spirit and scope of the accompanying claims.

We claim:

1. A digital messaging pen, comprising:

a housing;

a writing nib extending from one end of the housing;

an ink cartridge coupled to the writing nib, the ink cartridge providing ink to the writing nib;

an activation button located on the housing; and means for capturing a message responsive to a use of the activation button.

2. A digital messaging pen according to claim 1, the digital messaging pen further comprising a transmitter designed to transmit the message to a receiving device.

3. A digital messaging pen according to claim 2, wherein the means for capturing and the transmitter are contained within the housing.

4. A digital messaging pen according to claim 1, wherein the means for capturing includes:

an accelerometer designed to track a movement of the digital messaging pen in a plane parallel a writing surface;

a pressure sensor designed to sense when the digital messaging pen is moved off the writing surface; and a microcontroller designed to capture the message from data received from the accelerometer and pressure sensor.

5. A digital messaging pen according to claim 1, wherein the means for capturing includes an optical sensor designed to optically capture the message.

6. A digital messaging pen according to claim 1, the digital messaging pen further comprising a memory designed to store the message.

7. A digital messaging pen according to claim 1, the digital messaging pen further comprising:

a display designed to present a selection; and a selector operable in two independent axes, a first axis for changing the selection and a second axis for acceptance or rejection of the selection.

8. A digital messaging pen according to claim 7, wherein the selection is drawn from a plurality of stored messages and a plurality of destinations.

9. A digital messaging pen according to claim 1, the digital messaging pen further comprising a receiver designed to receive a message from a device.

10. A method for using a digital messaging pen, the method comprising:

activating a button located on a housing of the digital messaging pen;

capturing a message with the digital messaging pen responsive to an activation of the button;

selecting a destination for the message; and transmitting the message to a device.

11. A method according to claim 10, wherein capturing a message includes using motion and pressure sensors to determine the message.

12. A method according to claim 10, wherein capturing a message includes using an optical sensor to optically determine the message.

13. A method according to claim 10, wherein selecting a destination for the message includes:

navigating a menu using a selection device, the menu including at least one destination for the message and at least one level, the selection device operable in two independent axes, a first axis for changing a selection and a second axis for acceptance or rejection of the selection;

displaying the selected destination in a display.

14. A method according to claim 13, wherein navigating a menu includes updating the display as the selected destination changes.

15. A method according to claim 10, wherein the method further comprises selecting a message to transmit to the destination.

16. A method according to claim 10, wherein the method further comprises receiving a message from a device.

17. A method according to claim 16, wherein receiving a message includes displaying the received message in a display.

18. A digital messaging pen comprising:

a storage medium, said storage medium having stored thereon instructions, that, when executed by the digital messaging pen, result in:

activating a button located on a housing of the digital messaging pen;

capturing a message with the digital messaging pen responsive to an activation of the button;

selecting a destination for the message; and transmitting the message to a device.

19. A digital messaging pen according to claim 18, wherein capturing a message includes using motion and pressure sensors to determine the message.

20. A digital messaging pen according to claim 18, wherein capturing a message includes using an optical sensor to optically determine the message.

21. A digital messaging pen according to claim 18, wherein selecting a destination for the message includes:

navigating a menu using a selection device, the menu including at least one destination for the message and at least one level, the selection device operable in two independent axes, a first axis for changing a selection and a second axis for acceptance or rejection of the selection;

displaying the selected destination in a display.

22. A digital messaging pen according to claim 21, wherein navigating a menu includes updating the display as the selected destination changes.

23. A digital messaging pen according to claim 18, wherein:

the storage medium has further stored thereon instructions, that, when executed by the digital messaging pen, result in:

selecting a message to transmit to the destination.

24. A digital messaging pen according to claim 18, wherein:

the storage medium has further stored thereon instructions, that, when executed by the digital messaging pen, result in:

receiving a message from a device.

25. A digital messaging pen according to claim 24, wherein receiving a message includes displaying the received message in a display.

26. A digital messaging pen, comprising:

a housing;

a writing nib extending from one end of the housing;

an ink cartridge coupled to the writing tip, the ink cartridge providing ink to the writing nib;

means for tracking a motion of the digital messaging pen contained in the housing, thereby capturing a message; and a receiver designed to receive a message from a device.

27. A digital messaging pen, comprising:

a housing;

a writing nib extending from one end of the housing;

an ink cartridge coupled to the writing tip, the ink cartridge providing ink to the writing nib;

means for tracking a motion of the digital messaging pen contained in the housing, thereby capturing a message;

a display designed to present a selection; and a selector operable in two independent axes, a first axis for changing the selection and a second axis for acceptance or rejection of the selection.

28. A digital messaging pen according to claim 27, wherein the selection is drawn from a plurality of stored messages and a plurality of destinations.

29. A method for using a digital messaging pen, the method comprising:

capturing a message with the digital messaging pen;

navigating a menu using a selection device, the menu including at least one destination for the message and at least one level, the selection device operable in two independent axes, a first axis for changing a selection and a second axis for acceptance or rejection of the selection;

selecting a destination for the message using the selection device;

displaying the selected destination in a display; and transmitting the message to a device.

30. A method according to claim 29, wherein navigating a menu includes updating the display as the selected destination changes.

31. A method for using a digital messaging pen, the method comprising:

capturing a message with the digital messaging pen;

selecting a destination for the message;

transmitting the message to a device; and receiving a message from a device.

32. A method according to claim 31, wherein receiving a message includes displaying the received message in a display.

33. A digital messaging pen, comprising:

a storage medium, said storage medium having stored thereon instructions, that, when executed by the digital messaging pen, result in:

capturing a message with the digital messaging pen;

navigating a menu using a selection device, the menu including at least one destination for the message and at least one level, the selection device operable in two independent axes, a first axis for changing a selection and a second axis for acceptance or rejection of the selection;

selecting a destination for the message using the selection device;

displaying the selected destination in a display; and transmitting the message to a device.

34. A digital messaging pen according to claim 33, wherein navigating a menu includes updating the display as the selected destination changes.

35. A digital messaging pen, comprising:

a storage medium, said storage medium having stored thereon instructions, that, when executed by the digital messaging pen, result in:

capturing a message with the digital messaging pen;

selecting a destination for the message;

transmitting the message to a device; and receiving a message from a device.

36. A digital messaging pen according to claim 35, wherein receiving a message includes displaying the received message in a display.

* * * * *